US009157362B2

(12) United States Patent
Park

(10) Patent No.: US 9,157,362 B2
(45) Date of Patent: Oct. 13, 2015

(54) PRESSURE RELEASE SLOT FOR FAN NOISE IMPROVEMENT

(75) Inventor: Sang Bae Park, Northville, MI (US)

(73) Assignees: DENSO International America, Inc., Southfield, MI (US); DENSO CORPORATION, Kariya-shi, Aichi-ken (JP)

( * ) Notice: Subject to any disclaimer, the term of this patent is extended or adjusted under 35 U.S.C. 154(b) by 551 days.

(21) Appl. No.: 13/478,188

(22) Filed: May 23, 2012

(65) Prior Publication Data

US 2013/0315722 A1 Nov. 28, 2013

(51) Int. Cl.
*F01P 11/12* (2006.01)

(52) U.S. Cl.
CPC ..... *F01P 11/12* (2013.01)

(58) Field of Classification Search
CPC ..... F04D 29/52; F04D 29/526; F04D 29/663; F04D 29/68; F04D 29/682; F04D 29/685
USPC ..... 415/119, 182.1; 416/181, 189, 190, 416/93 R, 94
See application file for complete search history.

(56) References Cited

U.S. PATENT DOCUMENTS

| | | | | |
|---|---|---|---|---|
| 4,194,556 | A | 3/1980 | Watanabe et al. | |
| 5,131,352 | A * | 7/1992 | Hoshino et al. | 123/41.49 |
| 5,423,660 | A | 6/1995 | Sortor | |
| 5,460,485 | A * | 10/1995 | Sugiyama et al. | 415/208.2 |
| 5,484,262 | A * | 1/1996 | Thomas et al. | 415/178 |
| 5,522,457 | A * | 6/1996 | Lenz | 165/121 |
| 6,293,753 | B1 | 9/2001 | Pal et al. | |
| 6,454,527 | B2 | 9/2002 | Nishiyama et al. | |
| 6,676,371 | B1 * | 1/2004 | Brown | 415/173.1 |
| 6,874,990 | B2 | 4/2005 | Nadeau | |
| 6,896,095 | B2 * | 5/2005 | Shah et al. | 181/198 |
| 7,658,592 | B1 | 2/2010 | Jarrah et al. | |
| 7,891,464 | B2 * | 2/2011 | Tang et al. | 181/225 |
| 8,137,061 | B2 * | 3/2012 | Ito et al. | 415/182.1 |
| 2003/0183446 | A1 | 10/2003 | Shah et al. | |
| 2008/0286093 | A1 * | 11/2008 | Bauer, Jr. | 415/146 |
| 2009/0272341 | A1 * | 11/2009 | Ito et al. | 123/41.49 |
| 2014/0186172 | A1 * | 7/2014 | Schafer et al. | 415/209.1 |

FOREIGN PATENT DOCUMENTS

WO WO98/37319 8/1998

OTHER PUBLICATIONS

International Search Report issued Sep. 5, 2013 in corresponding International Application No. PCT/JP2013/003257.

* cited by examiner

*Primary Examiner* — Christopher Verdier
*Assistant Examiner* — Aaron R Eastman
(74) *Attorney, Agent, or Firm* — Harness, Dickey & Pierce, P.L.C.

(57) ABSTRACT

A fan shroud includes a body portion and a barrel portion. The body portion and the barrel portion have a first side and a second side. The barrel portion is adjacent to the body portion and defines a cylindrical opening for a fan. The barrel portion and the body portion define a slot in the fan shroud designed to release excess air pressure from the shroud. The slot extends through at least one of the first side and the second side. Any number of slots of different shapes and sizes may be arranged on the fan shroud to reduce noise radiating from the fan shroud.

14 Claims, 7 Drawing Sheets

PRESSURE RELEASE SLOT FOR FAN NOISE IMPROVEMENT

FIELD

The present disclosure relates to fan shrouds for use in the engine compartment of automobiles. More particularly, the present disclosure relates to fan shrouds configured to reduce noise in cooling fans.

BACKGROUND

The statements in this section merely provide background information related to the present disclosure and may not constitute prior art.

Automotive vehicles typically utilize an internal combustion engine to provide the power to operate the vehicle. Internal combustion engines generate heat due to the combustion process and it is necessary to continuously remove the excess heat from the vehicle's engine in order to maintain the operating temperature of the vehicle's engine at a specified level.

The usual method of removing this excess heat is an automotive cooling system. The cooling system utilizes a coolant pump which pumps coolant through the vehicle's engine to absorb the excess heat and then this heated fluid is pumped to a heat exchanger or radiator which removes the excess heat by performing a heat exchange process with ambient air. The coolant which has been cooled by the radiator is returned to the engine and the process continuously repeats itself. Typically, the temperature of the coolant is maintained at a minimum level using a thermostat or some other type of control system.

In order to reduce the size and thus the costs of the radiator, the automotive designer strives to have the radiator operate in the most efficient manner. One method used to maximize the efficiency of the radiator is to control the flow of ambient air through the radiator. This is accomplished by providing a fan which draws the ambient air through the radiator and then providing a fan shroud which ensures that the maximum amount of air is drawn through the radiator. The maximization of ambient air flow requires that the fan be located within the fan shroud.

A common problem with fans is the noise they generate during operation. The noise components generating the sound radiated by the cooling fan are tonal and overall noise. Tonal noise is a result of the rotation of the fan blades. Both tonal and overall noise are equally important for most cooling fans. Obstacles upstream and downstream of the fan create airflow disturbance and induce pressure fluctuation. Fan noise is typically caused by wall pressure fluctuation in the fan and shroud. This noise issue can be addressed by configuring the fan shroud to release this pressure thereby reducing the noise radiating from the cooling fan. The shroud must keep the same or equivalent airflow performance of the old design.

SUMMARY

This section provides a general summary of the disclosure, and is not a comprehensive disclosure of its full scope or all of its features.

The present disclosure provides a fan shroud which includes a body portion and a barrel portion. The barrel portion includes a plurality of fan stays. A plurality of slots are defined by the barrel portion and the body portion. Each of the slots is located between two fan stays. The plurality of slots reduce pressure fluctuation in the wall of the fan and shroud thereby reducing the noise radiated from the fan and shroud.

Depending on objects located upstream and downstream from the fan shroud, any number of slots in different shapes and sizes may be arranged in the shroud to reduce noise radiated by the fan and shroud.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only and are not intended to limit the scope of the present disclosure.

Figure 3A:
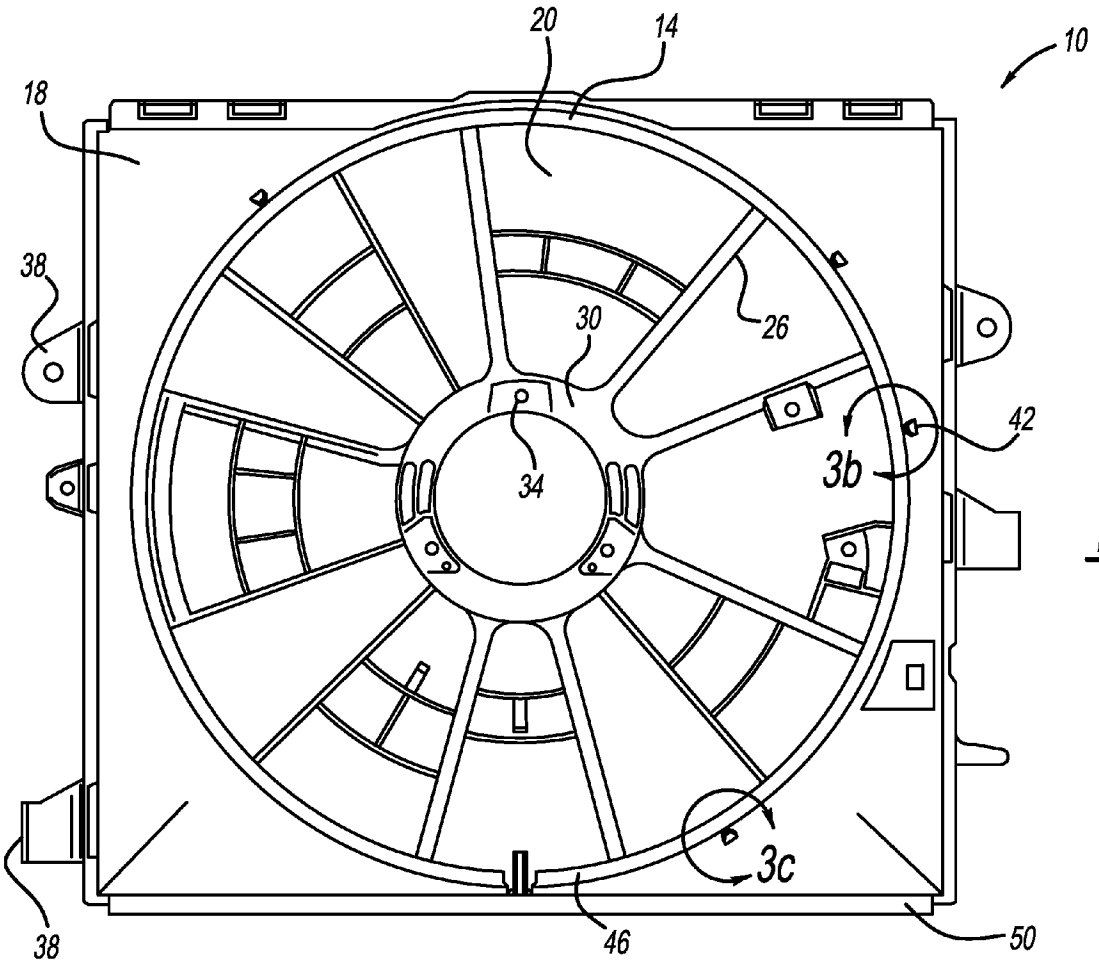
Figure 3B:
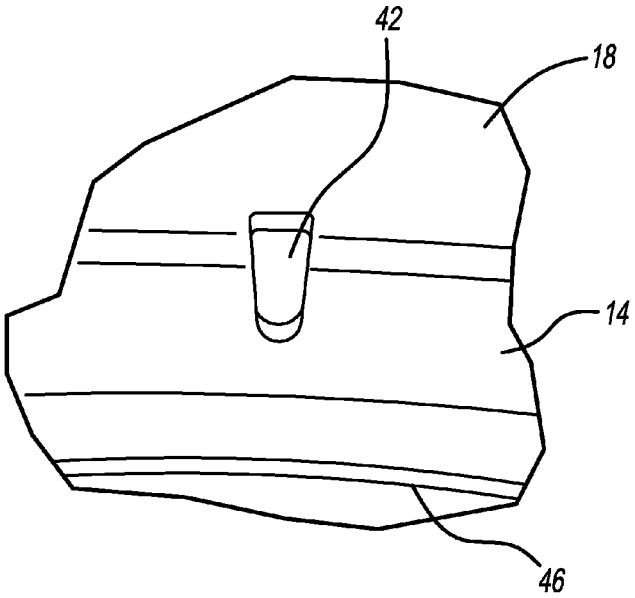
Figure 3C:
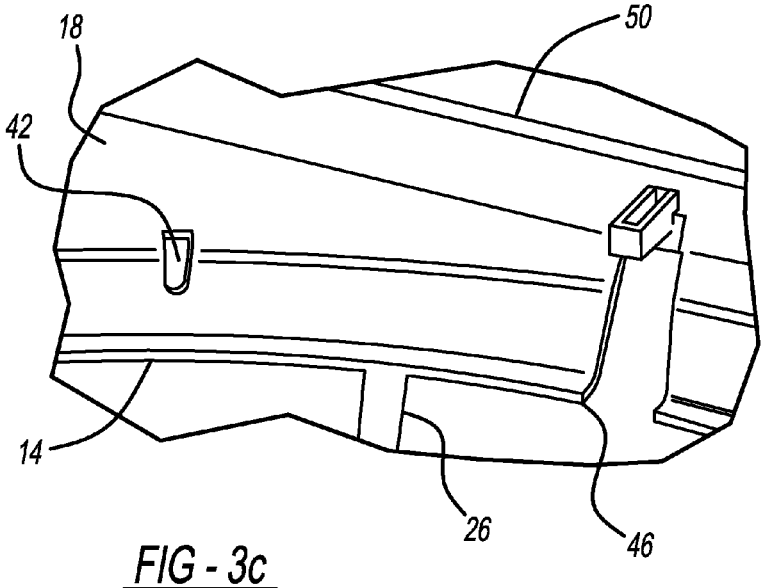
Figure 4A:
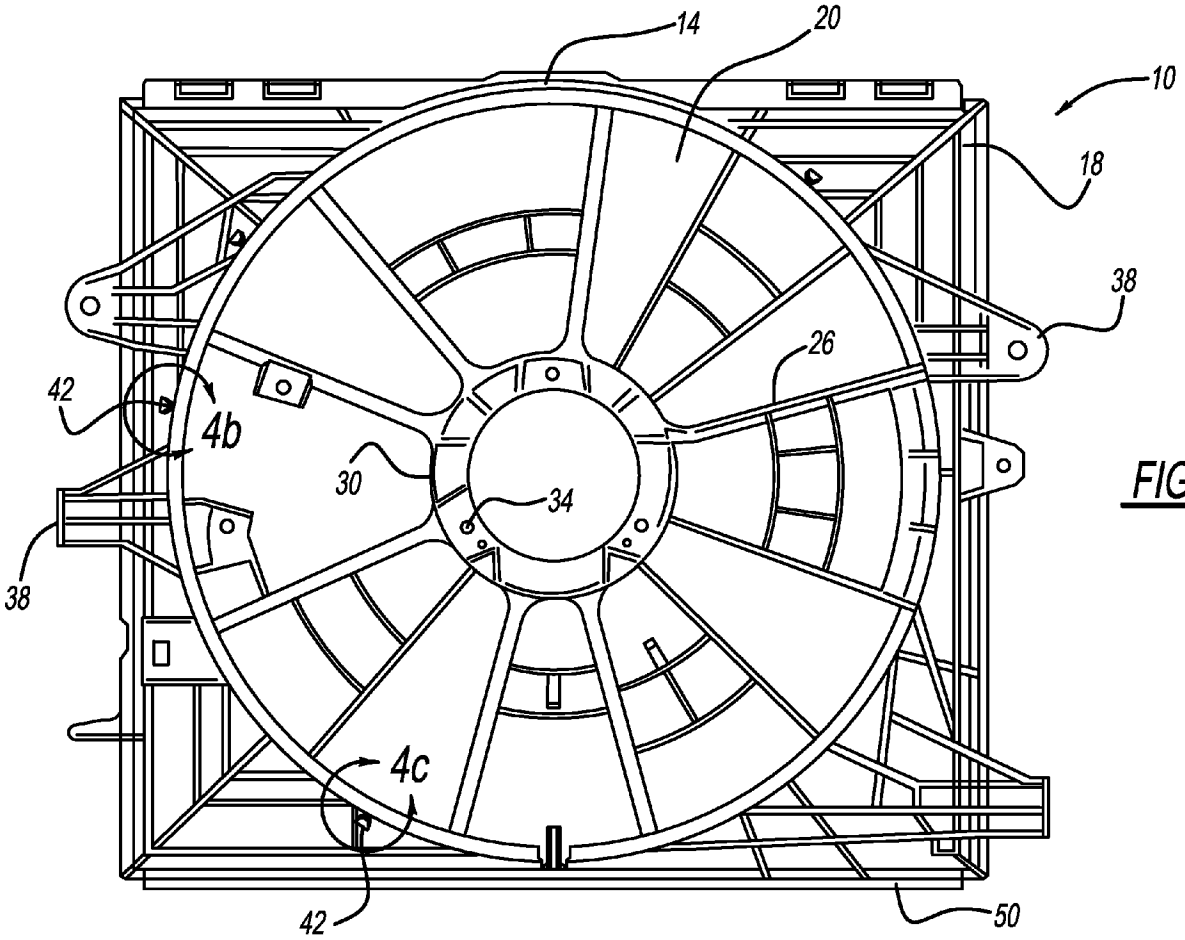
Figure 4B:
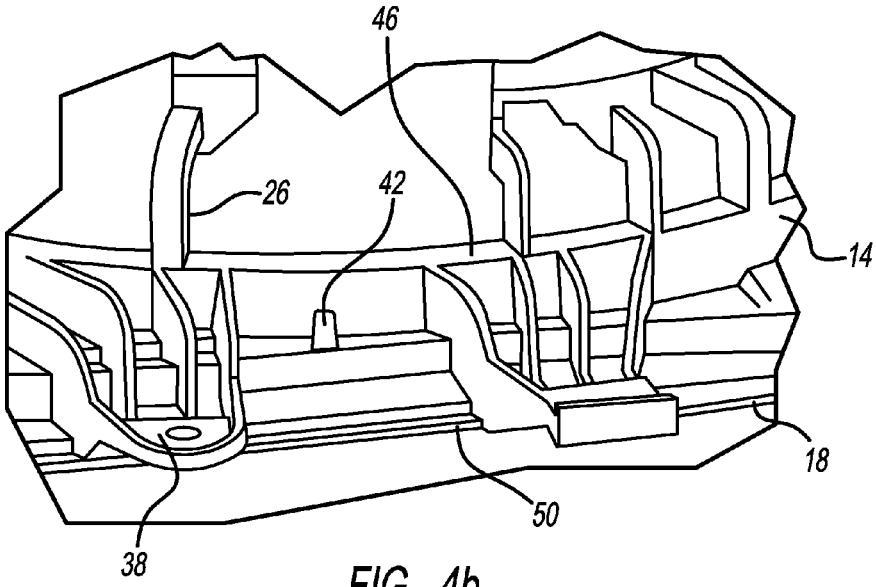
Figure 4C:
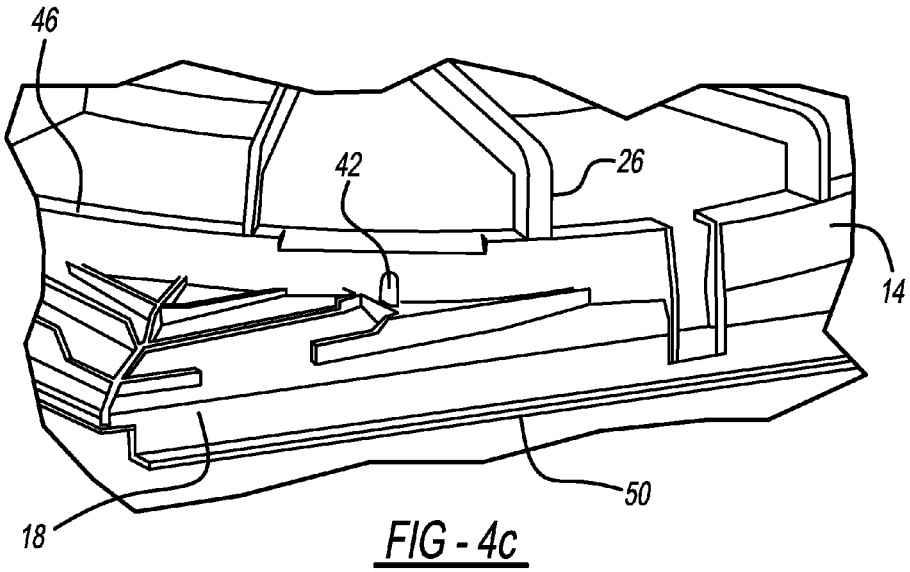
Figure 5:
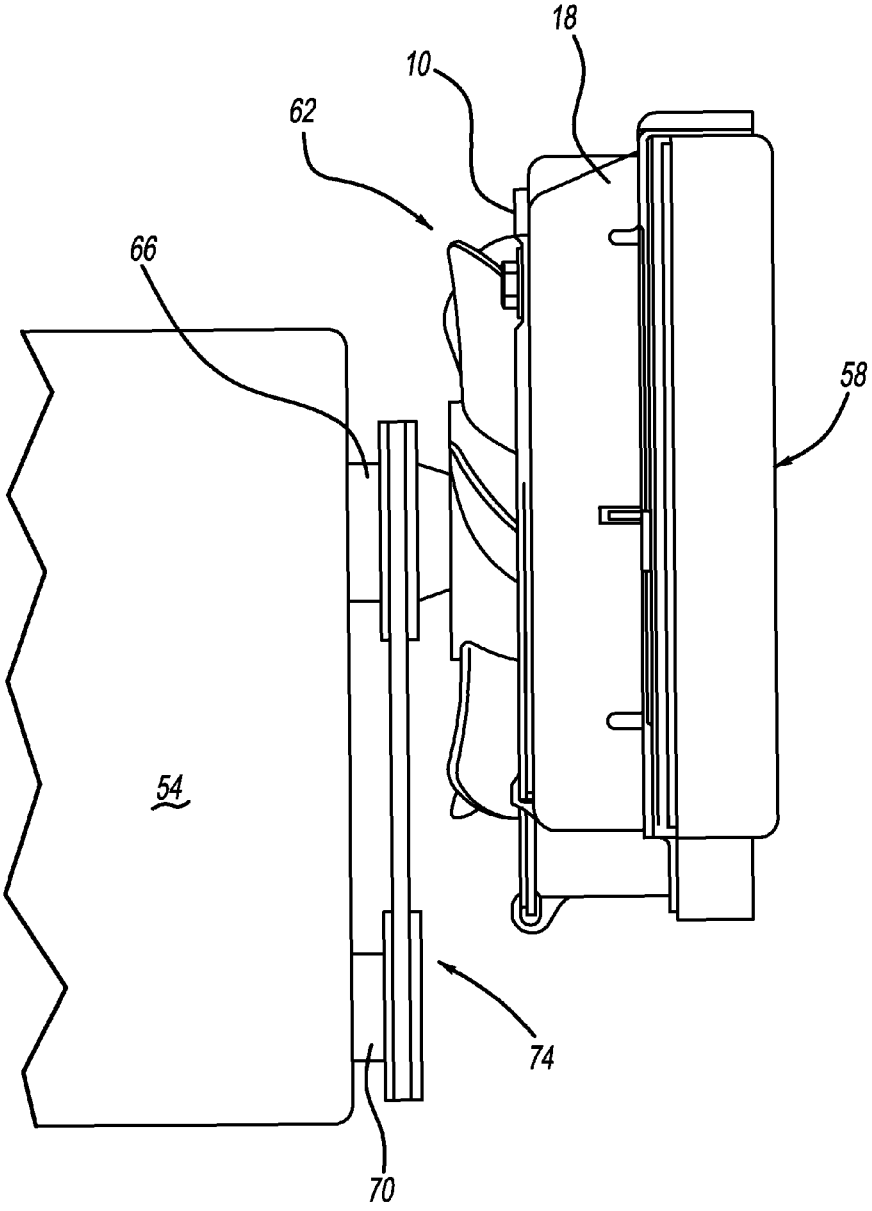

FIG. 3*a* is a front perspective view of a fan shroud in accordance with the present disclosure;

FIGS. 3*b*-3*c* are enlarged front perspective views of pressure release slots in accordance with the present disclosure;

FIG. 4*a* is a rear perspective view of the fan shroud in accordance with the present disclosure;

FIGS. 4*b*-4*c* are enlarged rear perspective views of the slots in accordance with the present disclosure; and FIG. 5 is a side perspective view of the fan shroud attached to an engine in accordance with the present disclosure.

Corresponding reference numerals indicate corresponding parts throughout the several views of the drawings.

DETAILED DESCRIPTION

Example embodiments will now be described more fully with reference to the accompanying drawings. The following description is merely exemplary in nature and is not intended to limit the present disclosure, application, or uses.

Figure 1:
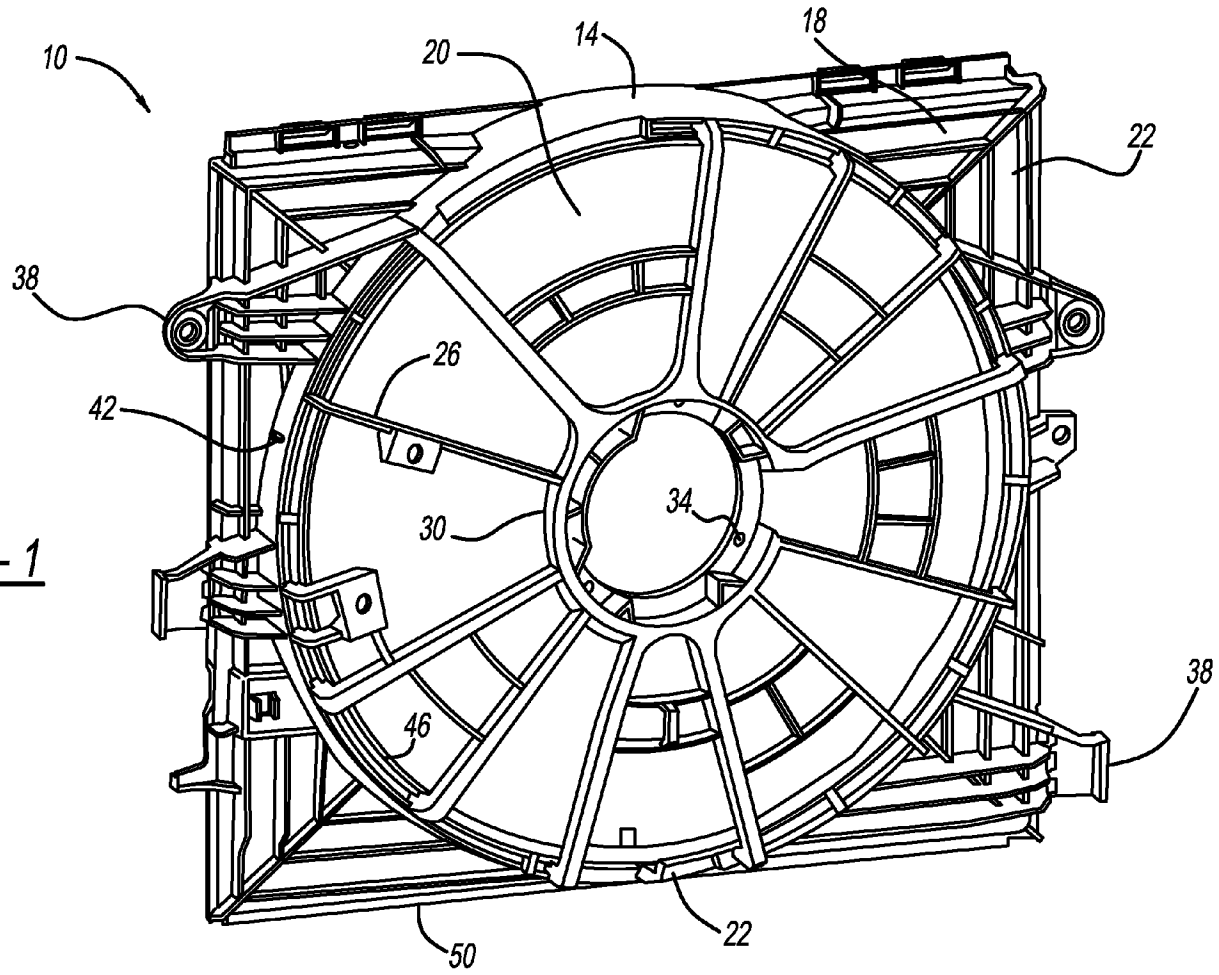
FIG. 1 is a front isometric view of a fan shroud in accordance with the present disclosure.
Figure 2:
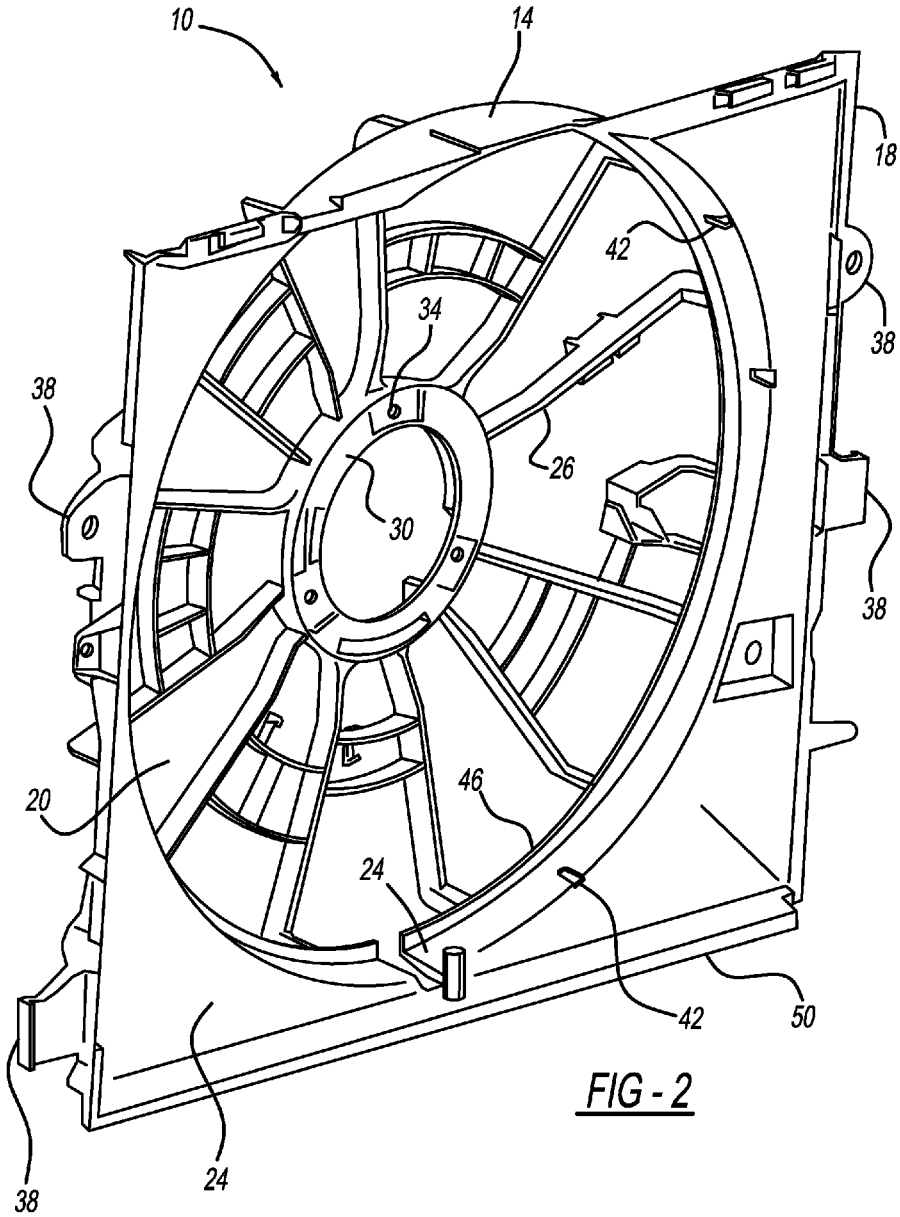
FIG. 2 is a rear isometric view of the fan shroud in accordance with the present disclosure.

FIGS. 1-2 illustrate a fan shroud 10 in accordance with the present disclosure. The fan shroud 10 includes a barrel portion 14 and a body portion 18, both of which are molded plastic components. While the barrel portion and the body portion 18 are described as plastic components, it is within the scope of the present disclosure to utilize any suitable material for the barrel portion 14 and the body portion 18. The barrel portion 14 is of a generally cylindrical shape and is directly adjacent to the body portion 18. The barrel portion 14 is located in the interior of the body portion 18 and defines an opening 20 which provides clearance for a coolant fan (not shown) during the operation of the vehicle. The barrel portion 14 and the body portion 18 have a first side 22 and a second side 24. As illustrated, the barrel portion 14 and the body portion 18 form a single piece integral molded fans shroud 10.

The barrel portion 14 includes a plurality of fan stays 26 connected to the first side 22 of the barrel portion 14 at various points along the circumference of the barrel portion 14. The plurality of fan stays 26 extend to the approximate center of the opening 20 and attach to a generally circular attachment means 30. The generally circular attachment means 30 defines a plurality of mounting supports 34 which are utilized to secure the fan shroud 10 to the coolant fan (not shown).

The body portion 18 is of a generally rectangular housing and includes a plurality of mounting supports 38 which are utilized to secure the fan shroud to the radiator (not shown). The body portion 18 further includes a plurality of pressure release slots 42 located in various locations where the body portion 18 meets the barrel portion 14. The pressure release slots 42 extend from the first side 22 through the second side 24 of the body portion 18 and the barrel portion 14. In the particular embodiment shown in FIGS. 1 and 2, four pressure release slots 42 are shown. However, it is within the scope of the present disclosure to utilize any number of pressure release slots 42. The size and number of pressure release slots 42 may vary in different applications based on fan shroud shape and obstacles located upstream and downstream of the fan. Obstacles located upstream and downstream of the fan create airflow disturbance and induce pressure fluctuation in the wall of the fan and shroud. The pressure release slots 42 decrease the noise radiated by the cooling fan by decreasing the pressure fluctuation in the wall of the fan and the fan shroud 10.

FIGS. 3*a*-3*c* illustrate front detailed views of the pressure release slots 42 in the fan shroud 10. Each pressure release slot 42 is located where the barrel portion 14 attaches to the body portion 18. The pressure release slot 42 is also located between two fan stays 26 on the shroud 10. The pressure release slot 42 is generally of a tapered baguette shape wherein the small end is of a semicircular shape. The pressure release slot 42 generally resembles the shape of the openings 20 between the fan stays 26 in the barrel portion 14 of the fan shroud 10. However, pressure release slots 42 of many different shapes and sizes are contemplated. The pressure release slots 42 are oriented in a direction generally parallel with the axis of rotation. However, depending on the location of obstacles upstream and downstream of the shroud 10, different orientations of the pressure release slots are contemplated. The pressure release slots 42 do not extend beyond a first edge 46 of the barrel portion 14 or a second edge 50 of the body portion 18. The fan shroud 10 may utilize any number of pressure release slots to decrease the pressure fluctuation in the wall of the fan and shroud.

FIGS. 4*a*-4*c* illustrate rear detailed views of the pressure release slots 42 in the fan shroud 10. The rear detailed views 4*a*-4*c* contain the same elements as detailed in the front detailed views 3*a*-3*c*.

FIG. 5 illustrates the fan shroud 10 attached to an engine 54 and a radiator 58. The radiator 58 is installed in a rear area of the engine 54. To the rear of the engine, an air-cooling fan 62 is rotatably supported via a fan shaft 66. Since the fan shaft 66 is connected to a main drive shaft (output shaft) 70 via a transmission mechanism 74, the air-cooling fan 62 is driven and rotated as the engine 54 operates.

To the front area of the radiator 58 and the rear area of the air-cooling fan 62, the fan shroud 10 is located to collect and guide air supplied by the air-cooling fan 62 to the radiator 58. The fan shroud body 18 is fixedly attached to the front surface side of the radiator 58 (the left side in FIG. 5). The cooling system is formed by the engine 54, the air-cooling fan 62, the radiator 58, the fan shroud 10, etc., as described above.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A fan shroud comprising:

a body portion and a barrel portion, the barrel portion is integral with the body portion at an outer periphery of the barrel portion;

wherein the body portion and the barrel portion have a first side and a second side, wherein the barrel portion defines a cylindrical opening for a fan; and the barrel portion and the body portion defining a slot in the fan shroud releasing excess air pressure from the shroud, wherein the slot extends from the first side through the second side of the body portion and the barrel portion;

wherein the slot is of a generally tapered shape with a small end being of a generally semicircular shape; and wherein the slot is located where the barrel portion mates with the body portion.

2. The fan shroud of claim 1, further comprising a plurality of slots, wherein a size and a location of the slots manages an airflow loss and a noise.

3. The fan shroud of claim 1, further comprising a plurality of fan stays.

4. The fan shroud of claim 3, where in the shroud has four slots, each positioned between two of the plurality of fan stays.

5. The fan shroud of claim 3, wherein the slot is located generally between two of the plurality of fan stays.

6. The fan shroud of claim 1, wherein the slot is oriented substantially parallel to an axis of rotation of the fan.

7. The fan shroud of claim 1, wherein the slot does not extend past a first edge of the barrel portion nor a second edge of the body portion.

8. The fan shroud of claim 1, wherein the fan shroud is disposed between a radiator and a fan of an engine cooling system, the fan configured to move air through the radiator.

9. A fan shroud comprising;

a barrel portion configured to accommodate a fan therein;

a body portion integral with the barrel portion at an outer edge of the barrel portion, the body portion extending about at least a portion of the outer edge of the barrel portion; and a plurality of slots configured to release excess air pressure from within the fan shroud, each slot defined by both the barrel portion and the body portion such that each slot extends from the barrel portion to the body portion, and such that each slot extends through both the barrel portion and the body portion; and wherein each of the plurality of slots is of a generally tapered shape with a small end being of a generally semicircular shape; and wherein each one of the plurality of slots is located where the barrel portion mates with the body portion.

10. The fan shroud of claim 9, wherein the barrel portion is generally circular, and the body portion extends entirely about the outer edge of the barrel portion.

11. The fan shroud of claim 9, wherein the barrel portion protrudes outward from a side of the body portion.

12. The fan shroud of claim 9, wherein the barrel portion includes a plurality of spaced apart fan stays extending radially outward from a center portion of the barrel portion.

13. The fan shroud of claim 12, wherein each one of the plurality of slots is between adjacent ones of the plurality of spaced apart fan stays.

14. The fan shroud of claim 9, wherein each one of the plurality of slots extends through both the barrel portion and the body portion from a first side of the barrel portion and the body portion to a second side of the barrel portion and the body portion, the first side is opposite to the second side.

* * * * *